United States Patent [19]

Kaneko et al.

[11] 4,176,266

[45] Nov. 27, 1979

[54] MICROWAVE HEATING APPARATUS

[75] Inventors: Yoichi Kaneko, Tokorozawa; Katsuhiro Kimura, Tokyo, both of Japan

[73] Assignee: Hitachi, Ltd., Japan

[21] Appl. No.: 763,088

[22] Filed: Jan. 27, 1977

[30] Foreign Application Priority Data

Feb. 2, 1976 [JP] Japan ..... 51-10143

[51] Int. Cl.[2] ..... H05B 9/06

[52] U.S. Cl. ..... 219/10.55 F

[58] Field of Search ..... 219/10.55 F, 10.55 R, 219/10.55 D; 343/708, 814, 781, 780, 812, 840; 333/84 M

[56] References Cited

U.S. PATENT DOCUMENTS

| | | | |
|---|---|---|---|
| 2,597,391 | 5/1952 | Sichak | 343/781 |
| 2,961,520 | 11/1960 | Long | 219/10.55 F |
| 2,962,716 | 11/1960 | Engelmann | 333/84 M |
| 3,005,986 | 10/1961 | Reed | 343/708 |
| 3,221,132 | 11/1965 | Staats | 219/10.55 F |
| 3,377,562 | 4/1968 | Staats | 219/10.55 F |
| 3,436,507 | 4/1969 | Puschner | 219/10.55 F |
| 3,737,906 | 6/1973 | Maynard | 343/814 |
| 3,789,179 | 1/1974 | Haagensen | 219/10.55 F |
| 4,028,521 | 6/1977 | Uyeda et al. | 219/10.55 F |
| 4,037,071 | 7/1977 | Kaufman, Jr. et al. | 219/10.55 M |

FOREIGN PATENT DOCUMENTS

| | | | |
|---|---|---|---|
| 1093929 | 12/1957 | Fed. Rep. of Germany | 219/10.55 F |
| 2524470 | 12/1976 | Fed. Rep. of Germany | 219/10.55 F |
| 2622173 | 12/1976 | Fed. Rep. of Germany | 219/10.55 F |
| 53193 | 9/1945 | France | 343/780 |
| 4640978 | 3/1967 | Japan | 219/10.55 F |
| 4640980 | 3/1967 | Japan | 219/10.55 F |
| 47-39248 | 10/1972 | Japan | 219/10.55 F |
| 666074 | 2/1952 | United Kingdom | 219/10.55 F |

OTHER PUBLICATIONS

Application of Microwave Tehniques to Microwave Ovens, Nakahara et al., Mitsubishi Denki Engr. No. 29, Jun. 1971.

*Primary Examiner*—Roy N. Envall, Jr.
*Assistant Examiner*—Bernard Roskoski
*Attorney, Agent, or Firm*—Craig and Antonelli

[57] ABSTRACT

Microwave heating apparatus comprising a fan beam radiator exhibiting a pattern of microwave radiation which is concentrated in the angular direction and less concentrated in the radial direction with respect to a shaft set substantially at the center of an oven and rotating a microwave beam and an article to-be-heated relative to each other, thereby to uniformly heat the article by applying the rotating beam.

15 Claims, 9 Drawing Figures

MICROWAVE HEATING APPARATUS

BACKGROUND OF THE INVENTION

1. Field of the Invention

This invention relates to microwave heating apparatus, and more particularly to microwave heating apparatus which heats an article to-be-heated uniformly.

2. Description of the Prior Art

As methods for uniformly heating an article to-be-heated, there have heretofore been ones described below.

(i) Use of a plurality of sources:

In this method, heating apparatus is equipped with a plurality of microwave generating sources. The sources have electric-wave radiation ports for irradiating a heating chamber (oven) by microwaves independently of one another, and the microwaves are radiated towards an article to-be-heated placed within the oven.

(ii) Provision of a plurality of openings for radiation:

Electromagnetic wave energy is supplied by a single power source, and a plurality of electric-wave radiation ports towards a heating chamber are provided.

(iii) Resonator (secondary antenna):

Electromagnetic waves radiated from a high-frequency power source are excited in an antenna, from which microwaves are radiated towards an article to-be-heated.

(iv) Stirrer fan:

Electromagnetic waves in a heating chamber are scattered by rotating a stirrer (electric-wave agitating vane).

(V) Turntable:

A table on which an article to-be-heated is placed is rotated. Thus, the same effect as in scattering electromagnetic waves is achieved.

Among such various methods proposed, especially those (iv) and (v) are structurally simple and greatly effective and are therefore adopted extensively at present. However, they do not bring forth a satisfactory solution to, for example, the problem that the peripheral part of the article to-be-heated or the cap part of a milk bottle is prone to be overheated, i.e., the problem of nonuniform heating.

The nonuniform heating is ascribable to nonuniform distribution of the electromagnetic field in the heating chamber. As the causes therefor, the following are considered:

(a) Inhomogeneous application of radiated waves from a feeding point.

(b) Standing waves due to reflected waves from the wall of the heating chamber.

(c) Standing waves due to reflected waves from the food or the article to-be-heated.

It is a most important object to eliminate especially the causes (a) and (b) among them.

The stirrer fan system (iv) is effective for solving the problem (a). In order to achieve a satisfactory effect, however, the stirrer fan need be made large to the extent of occupying a sufficient space relative to the size of the heating chamber. This leads to the disadvantages that a driving motor becomes large-sized and that the cooking space in the heating chamber becomes small. The turntable system (v) is effective for solving the problem (b). Besides, it is easy in control and comparatively good in the uniform heating. However, it is prone to bring about the nonuniform heating in the radial direction in such a manner that the peripheral part of the article to-be-heated is heated more easily than the central part. Further, by combining it with the multi-source system (i) or the multi-opening radiation system (ii), the nonuniform heating in the radial direction can be reduced. This, however, renders the cost high on account of the increase of the number of power sources of the complication of the structure. It may be said that any practical method for reducing the nonuniform heating has not been developed yet.

SUMMARY OF THE INVENTION

An object of this invention is to provide microwave heating apparatus which heats an article to-be-heated uniformly and which is free from nonuniform heating.

Another object of this invention is to provide microwave heating apparatus which is inexpensive.

In order to accomplish such objects, this invention realizes the uniform heating in such a way that the radiation pattern of microwave energy to irradiate the interior of a heating chamber is put into a distribution spreading in the radial direction and the angular direction, i.e., the so-called fan beam, and that the microwave beam is rotated, whereby the microwave distribution in the heating chamber is made uniform and the concentration of energy on a specific part of the article to-be-heated as in the prior art is prevented.

DESCRIPTION OF THE PREFERRED EMBODIMENTS

Figure 1:
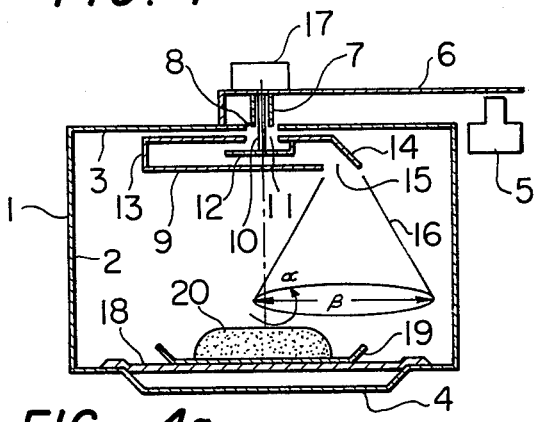
FIG. 1 is a schematic sectional view showing the construction of an embodiment of this invention.

FIG. 1 is a sectional view showing the construction of an embodiment of the microwave heating apparatus to which this invention is applied. An oven (heating chamber) 1 is composed of side walls 2, and upper and lower boards 3 and 4 which are substantially square or rectangular. A microwave oscillating source 5 employing a magnetron or the like, and a waveguide 6 are arranged above the upper board 3. Microwaves pass through a post 7 and an opening 8, and are supplied to a fan beam radiator 9 which is arranged at a central upper part of the interior of the oven 1.

The fan beam radiator 9 is composed of a primary radiator 12 (a waveguide one end of which is short-circuited and the other end of which is open), a reflector 13 which has a section approximate to an ellipse, and a reflecting plate 14 which reflects the microwaves from the reflector 13 into the heating chamber 1. The opening 8 and the fan beam radiator 9 are electromagnetically connected by an opening 11 provided in the fan beam radiator 9 (the opening 11 is provided in proximity to the opening 8, and a center shaft 10 connected to a motor 17 extends through the openings 8 and 11). Accordingly, the microwaves having passed through the opening 8 further pass through the opening 11, are radiated from the primary radiator 12 leftwards as viewed in the figure, and are reflected by the reflector 13. At this time, since the reflector 13 has the section approximate to the ellipse with its focus lying on the center shaft 10, the reflected microwaves have a distribution of radiated energy concentrated in the radial direction and the moving direction with respect to the center shaft 10. That is, the reflected microwaves form a fan beam. The fan beam is radiated into the oven 1 as indicated at 16 by an opening 15 and the reflecting plate 14. The reflecting plate 14 is mounted on the fore end of the reflector 13.

When the center shaft 10 supporting the fan beam radiator 9 is driven by the motor 17, the fan beam 16 imparts heating energy by the rotational scanning to an article to-be-heated 20 put on a container 19 on a plate 18 made of a dielectric material.

Figure 2:
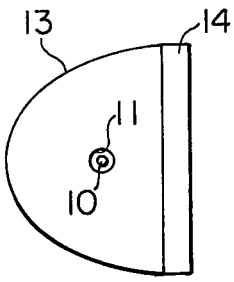
FIGS. 2 and 3 are a top view and a side view of a fan beam radiator which is employed in the embodiment of FIG. 1, respectively.
Figure 3:
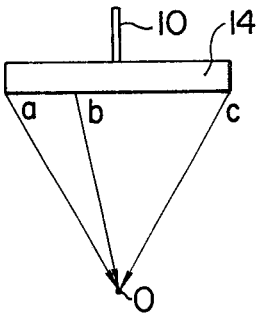

Referring now to FIGS. 2 and 3, the structure of the fan beam radiator 9 will be described more in detail.

The fan beam radiator 9 includes the reflector 13 which has the shape of an ellipsoid, a paraboloid or the like, and the reflecting plate 14 which has the shape of a plane, a concave surface or the like.

The waves reflected at the ellipsoidal reflection surface 13 are concentrated to the another focal point, in order to form a fan beam, which is directed downward by the reflecting plate 14 like a, b, and c indicated in FIG. 3. The concentration in the angular direction of the beam rotation axis is higher than in the radial direction.

Accordingly, when a point of convergence 0 is set so as to exist at a part lower than the article to-be-heated 20 in FIG. 1 (for example, on the dielectric supporter plate 18), a pattern of microwave energy (fan beam) having an elliptic section which is narrow or more concentrated in the angular direction (shown by the arrow d) or the moving direction of the center shaft 10 of the axis of rotation of the beam and broad or less concentrated in the radial direction (shown by the arrow $\beta$) with respect to the axis of rotation can be obtained at the part of the article to-be-heated 20. That is, the microwave beam has an energy pattern distributed in a plane perpendicular to the rotational axis in such a manner as to be more narrow in an angular direction with respect to the axis of rotation than in a radial direction with respect to the axis of rotation.

In case where the reflective surface of the reflector 13 is made the paraboloid instead of the ellipsoid, the reflected waves a, b and c proceed downwardly in parallel without converging. Since, however, they do not spread, they also become a fan beam which is concentrated to be narrower in the angular direction than in the radial direction. In this case, however, the degree of concentration in the angular direction is lower than in the previous case where the reflector 13 is the ellipsoid, so that the sectional shape of the fan beam becomes closer to a circle.

Further, by constructing the reflective surface the reflector 13, by, for example, the combination of cylindrical surfaces of planar surfaces, it is possible to arbitrarily vary the projection beam shape into various ones such as a circle and a rectangle.

As explained above, according to this invention, the portion to-be-heated is irradiated by rotating the fan beam, so that various effects to be stated below are achieved.

(1) It becomes possible that the incident energy arriving directly from the fan beam radiator 9 is uniformly given in the angular direction. (2) The microwave radiation reflected by the side wall 2 or by that area of the lower board 4 on which no food exists is effectively subject to irregular reflection because the plane of polarization thereof varies every moment owing to the rotation. Consequently, no fixed standing wave is formed, and the nonuniform heating can be reduced.

(3) In the prior art, in case where the microwaves irregularly reflected in the oven are absorbed by the food, the peripheral part of the food tends to be heated earlier than the central part thereof. In contrast, according to this invention, the uniform heating can be achieved as a whole by setting the opening 15 at a position spaced from the axis of rotation and adjusting to about 45° the angle which the reflective surface of the reflecting plate 14 defines with the horizontal plane, thereby to concentrate the energy from the reflecting plate 14 directly onto the central part of the food.

(4) In case of heating an object stretching in the height direction, such as a milk bottle, overheating of a part on which an electric field is prone to be concentrated, such as the neck part of the bottle, can be moderated.

This comes from the fact that, as shown in FIG. 1, the energy distribution of the fan beam is such that the energy disperses along the longitudinal direction of the reflecting plate 14 in the vicinity of the opening part and that no energy exists in the vicinity of the axis of rotation at the upper part of the oven.

(5) The nonuniform heating in the vertical direction can be eliminated in such a way that the distance between the lower surface of the lower board 4 and the upper surface of the plate 18 is set to be a little less than a quarter wavelength so that the electric fields parallel to the horizontal plane in the scattered waves may become intense at the lower part of the article to-be-heated 20.

(6) The equivalent line length from the magnetron to the oven can be made large, and the moding in the case of an overload can be prevented by the so-called long line effect.

More specifically, with prior-art heating apparatus in which the magnetron is directly coupled to the oven, in case of an overload, the oscillation stops or becomes unstable and there is the danger of damaging the magnetron. In contrast, according to this invention, the microwave energy is transferred from the center shaft 10 of the fan beam radiator to the antenna opening. Thus, the fan beam radiator can effectively increase the line length between the magnetron and the load to prevent the magnetron moding.

Figure 4A:
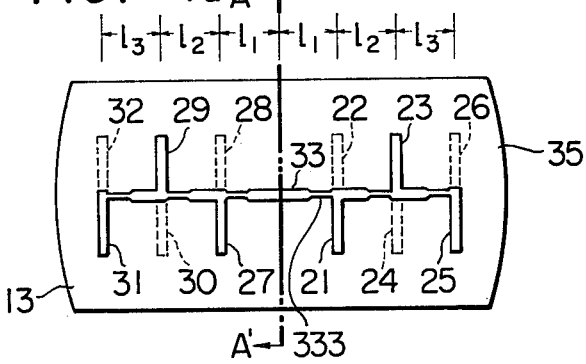
FIGS. 4*a* and 4*b* are views each showing a modification of the fan beam radiator employed in this invention.
Figure 5:
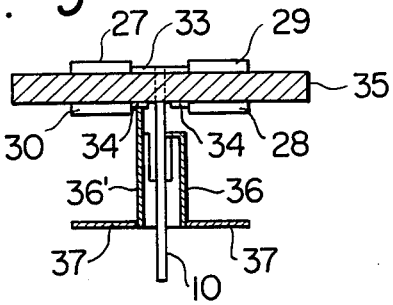
FIG. 5 is a sectional view of the fan beam radiator in FIG. 4*a*.

FIG. 4*a* and FIG. 5 show another embodiment of the fan beam radiator which is employed in this invention. FIG. 4*a* is a plan view of the embodiment, and FIG. 5 is a sectional view taken along a line A–A′ in FIG. 4*a*. Hereunder, the construction of the embodiment will be described. The fan beam radiator 9 has a structure in which six sets of dipole arrays 21, 22; . . . and 31, 32 and feeders 33 and 34 are arranged in one row in the longitudinal direction of a dielectric substrate 35 on The supply of the microwave energy to the dipoles is achieved by using a balanced pair line feeder coupled with an unbalanced coaxial line. Thus, the plus and minus potentials of the dipoles are balanced to the ground potential. A balun 36 and a balun 36' serve as outer conductors and a center conductor is connected at one of the outer conductors for transforming an unbalanced line to a balanced line in a conventional manner. The supply of the microwaves to the dipoles will be explained with reference to FIG. 5. The conversion of the mode is executed by the center shaft 10 corresponding to an inner conductor and baluns 36 and 36' corresponding to outer conductors. The center shaft 10 penetrates through the dielectric substrate 35, and is connected to the feeder 33. One end of the baluns 36 is connected to the center shaft 10, while the other end thereof is effectively short-circuited to the top of the oven without contact through a metal strap 37. One end of the balun 36' is connected to the feeder 34, while the other end thereof is short-circuited without contact through the metal strap 37 likewise to the balun 36. The feeder 33 is connected to the center shaft 10, and feeds the balanced mode along with the feeder 34.

Such feeders 33 and 34 supply to the dipoles microwave powers having a phase difference of 180° therebetween. $\frac{1}{4}$ wavelength transformers exist between the feeder 33 and the dipoles 27 and 21, and perform impedance matching.

In case where the intervals of arrayal of the dipoles, $l_1$, $l_2$, $l_3$ are made equal to about $\frac{1}{2}$ of the effective wavelength of the microwaves supplied from the feeders 33 and 34, in-phase waves are excited in a direction orthogonal to the surfaces of arrayal of the dipoles (i.e., both the front and rear surfaces of the dielectric substrate 35).

That is, the fan beam radiator in FIG. 4*a* is mounted under the state under which the centers of the feeders 33 and 34 coincide with the position of the center axis in FIG. 1, whereby the microwaves excited from the respective dipoles can be made in-phase on the article to-be-heated 20. Accordingly, a fan beam is formed which is narrow in the horizontal direction (longitudinal direction) and wide in the vertical direction as viewed in FIG. 4*a*.

In case where the intervals of the dipoles are made $l_1 > l_2 > l_3$, it is possible to suppress the spread of the beam in the horizontal direction and converge the beam onto the lower surface of the oven so as to enhance the effect of uniform heating.

The embodiment of FIG. 4*a* is constructed as if a pair of dipoles at the closest position to the feeding point were removed. Thus, the energy density at the central upper part of the oven is made relatively low, and the effect of preventing the overheating of the upper part of the milk bottle or the like is bestowed.

Figure 4B:
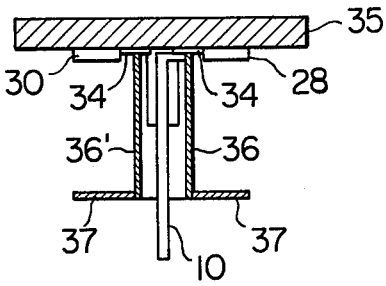

Although the embodiment of FIG. 4*a* is provided with the dipoles on both the surfaces of the dielectric substrate, this invention can adopt a fan beam radiator which is provided with the dipoles on either the front or rear surface of the dielectric substrate. FIG. 4*b* shows a case where the dipole arrays are provided on the rear surface. In FIG. 4*b*, the same symbols as in FIG. 4*a* designate the same or equivalent parts, and the center shaft 10 is connected to the feeder 34.

Further, although both FIGS. 4*a* and 4*b* illustrate the case of employing the dielectric substrate, it is a matter of course that the dielectric substrate need not be employed.

According to the flat fan beam radiators disclosed in the embodiments, the driving motor can be made small-sized and the occupying space of the radiator in the oven is small, so that the height of the oven can be decreased.

Although, in the embodiments described thus far, the fan beam radiator is arranged at the upper part of the interior of the oven, it is also possible to arrange the fan beam radiator between the lower board of the oven and the article to-be-heated and to rotatingly apply the microwave energy from below the article to-be-heated.

There may be employed a construction wherein the fan beam radiator of this invention is arranged in an oven which is composed of cylindrical side walls or side walls of nearly cylindrical polygons, instead of the conventional oven in the shape of a substantially hexahedral box. In the oven of such configuration, in the prior art, the nonuniform heating in the angular direction is made conspicuously little by the so-called turntable system in which the table with the article to-be-heated placed thereon is rotated. According to this invention, an equal or higher effect can be achieved by the simple structure with the article to-be-heated fixed.

Figure 6:
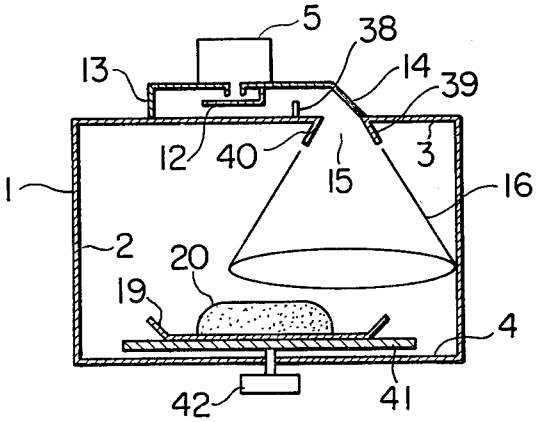
FIG. 6 is a schematic sectional view showing the construction of another embodiment of this invention.

FIG. 6 is a sectional view of another embodiment of the microwave heating apparatus to which this invention is applied. An oven 1 is composed of side walls 2, and upper and lower boards 3 and 4 which are substantially square. A Microwave source 5 is fixed to the upper board 3. A fan beam radiator is composed of a primary radiator 12, a reflective surface 13 which serves to rightwardly reflect microwaves radiated leftwards from the primary radiator 12 and which is formed of an ellipsoid, a paraboloid or the like, a reflecting plate 14, and an opening 15. Thus, a fan beam 16 is formed and is projected towards the lower part of the oven.

A container 19 and an article to-be-heated 20 are put on a turntable 41 which is rotated and driven by a motor 42, and they are irradiated relatively rotatingly by the fixed fan beam 16. In this embodiment, the scattering effect of microwave energy by reflection from the side wall 2 is lower than in the case of the embodiment shown in FIG. 1. However, nonuniform heating within a plane can be improved by the turntable.

When the fan beam is rotated in the state illustrated in FIG. 1, both the fan beam and the article to-be-heated are rotated, and the effect of scattering from the side wall is also added. In consequence, the nonuniform heating can be more improved over the entire article to-be-heated.

In FIG. 6, a coupling adjusting plate 38 which is in the shape of an elongate plate and which is arranged near the opening 15 serves to match the microwave source 5 and the load. It is disposed between the reflective surface of the reflector 13 and the reflecting plate 14. Beam shaping plates 39 and 40 adjusts the direction of the fan beam instead of adjusting the position of the opening 15, and makes the heating energy distribution in the radial direction appropriate. They are disposed at the fore end of the reflecting plate 14. Depending on the kind of the article to-be-heated, the beam shaping plates vary the radiation angle of the beam so as to attain the optimum heating effect.

Figure 7:
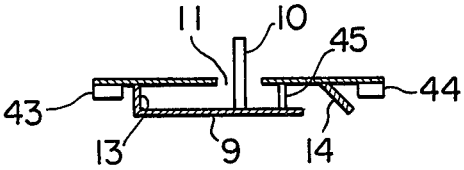
FIG. 7 is a view showing a modification of the fan beam radiator employed in this invention.

FIG. 7 is a sectional view showing the construction of another embodiment of the fan beam radiator employed in this invention. The embodiment is suited to rotate the fan beam radiator by a wind force. In the figure, the same symbols as in FIG. 1 designate the same or equivalent parts. Numerals 43 and 44 designate vanes, and numeral 45 a stub. The stub 45 acts as a simple primary radiator for establishing matching with the oven side (load) and suppressing the direct radiation of microwave energy from the center shaft 10 rightwards as viewed in the figure so as to form a desired fan beam.

Figure 8:
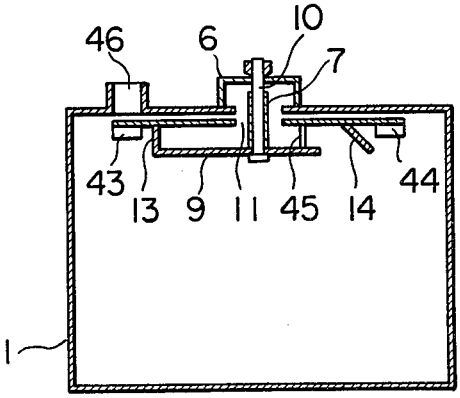
FIG. 8 is a view showing the construction of this invention as uses the fan beam radiator shown in FIG. 7.

The construction of an embodiment of this invention in the case of heating the article to-be-heated with such fan beam radiator is illustrated in FIG. 8. In the figure, the same symbols as in FIG. 1 designate the same or equivalent parts. The fan beam radiator 9 is supported by the shaft 10 (made of, for example, teflon) and the post 7. Shown at 46 is a duct, which sends air to the fan beam radiator 9. The fan beam radiator 9 is rotated by the vanes 43 and 44 (mounted at an angle of, for example, 45°). According to this embodiment, the motor which is attached to the shaft of the fan beam radiator as in the embodiment of FIG. 1 becomes unnecessary, and the structure is simplified.

We claim:

1. Heating apparatus wherein an article to-be-heated placed in an oven is irradiated by microwaves from a microwave source and is thus heated, comprising:

means for generating a microwave beam, and means to relatively rotate the microwave beam with respect to an article to-be-heated about an axis of rotation and to impart heating energy to the article to-be-heated, the microwave beam having an energy pattern distributed in a plane perpendicular to the rotational axis in such a manner as to be more narrow in an angular direction with respect to the axis of rotation than in a radial direction with respect to the axis of rotation.

2. The heating apparatus according to claim 1, wherein said generation means comprises:

a rotatable reflector which reflect microwaves from a microwave source, said reflector having a substantially elliptic reflective surface to concentrate the microwave energy, and a reflecting plate which changes the direction of radiation of the microwave energy to direct the microwave beam toward the article to-be-heated.

3. The heating apparatus according to claim 2, wherein said reflector has a parabolic reflective surface.

4. The heating apparatus according to claim 1, wherein said generation means comprises:

a plurality of sets of dipole arrays, said dipole arrays being arranged in one row in a longitudinal direction of a dielectric substrate on a front surface and a rear surface of said dielectric substrate, feeders which transmit the microwaves to said dipole arrays, said feeders being provided on said front surface and said rear surface of said dielectric substrate and being connected to one of the sets of said dipole arrays, and supply means to supply said microwaves from a microwave source to said dipole arrays through said feeders.

5. The heating apparatus according to claim 4, wherein said supply means comprises conversion means to convert a propagation mode of said microwaves from an unbalanced mode into a balanced mode.

6. The heating apparatus according to claim 5, wherein said conversion means comprises:

an inner conductor, one end of which is connected to the feeder provided on said front surface of said dielectric substrate and the other end of which receives said microwaves from the microwave source, and a pair of outer conductors which are provided outside said inner conductor, one end of one of said outer conductors being connected to said inner conductor and the other end thereof being short-circuited, one end of the other outer conductor being connected to the feeder provided on said rear surface of said dielectric substrate and the other end thereof being short-circuited.

7. The heating apparatus according to claim 6, wherein said outer conductors are baluns.

8. The heating apparatus according to claim 2, wherein said generation means further comprises:

a coupling adjusting plate which is provided between said reflective surface of said reflector and said reflecting plate, and beam shaping plates which are provided at a fore end of said reflecting plate.

9. The heating apparatus according to claim 2, wherein said generation means includes a primary radiator constructed as a stub, and said means to rotate includes a plurality of vanes for effecting rotation of the microwave beam in response to wind force.

10. The heating apparatus according to claim 1, wherein said generation means comprises:

a plurality of sets of dipole arrays, feeders which are connected to one of the sets of said dipole arrays, and supply means to supply said microwaves from the microwave source to said dipole arrays through said feeders.

11. The heating apparatus according to claim 10, wherein said supply means comprises conversion means to convert a propagation mode of said microwaves from an unbalanced mode into a balanced mode.

12. The heating apparatus according to claim 11, wherein said conversion means comprises:

an inner conductor, one end of which is connected to the feeder and the other end of which receives said microwaves from the microwave source, and a pair of outer conductors which are provided outside said inner conductor, one end of one of said outer conductors being connected to said inner conductor and the other end thereof being short-circuited, one end of the other outer conductor being connected to the feeder and the other end thereof being short-circuited.

13. A heating apparatus wherein an article to-be-heated placed in an oven is irradiated by microwaves from a microwave source and is thus heated, comprising means for generating a microwave beam toward an article to-be-heated, and means for relatively rotating the microwave beam and the article to-be-heated, said generating means providing a microwave beam emanating from a position spaced from a rotation axis of the microwave beam or the article to-be-heated, the microwave beam having a portion extending at least to the rotational axis in a lower region of the oven, the microwave beam having an energy pattern distributed in a plane perpendicular to the rotation axis in such a manner as to be more narrow in an angular direction with respect to the axis of rotation than in a radial direction with respect to the axis of rotation.

14. The heating apparatus according to claim 13, wherein the beam is a fan beam.

15. The heating apparatus according to claim 13, wherein the beam rotates and the article to-be-heated is stationary.

* * * * *